US005816560A

United States Patent [19]

Obser

[11] Patent Number: 5,816,560

[45] Date of Patent: Oct. 6, 1998

[54] TWO-STAGE GAS VALVE

[75] Inventor: Michael Obser, Essen, Germany

[73] Assignee: Johnson Controls Technology Company

[21] Appl. No.: 985,433

[22] Filed: Dec. 4, 1997

[30] Foreign Application Priority Data

Dec. 5, 1996 [DE] Germany ..... 196 50 445.7

[51] Int. Cl.[6] ..... F16K 31/02

[52] U.S. Cl. ..... 251/129.15; 137/625.33; 251/129.08

[58] Field of Search ..... 251/129.15, 129.08, 251/129.18; 137/625.33

[56] References Cited

U.S. PATENT DOCUMENTS

| | | | |
|---|---|---|---|
| 4,313,590 | 2/1982 | Nishimiya | 251/129.08 |
| 4,314,585 | 2/1982 | Nishimiya et al. | 251/129.08 |
| 4,637,429 | 1/1987 | Dietiker et al. | 251/129.18 |
| 5,238,222 | 8/1993 | Sumida et al. | 251/129.15 |
| 5,263,514 | 11/1993 | Reeves | 137/625.33 |

FOREIGN PATENT DOCUMENTS

| | | | |
|---|---|---|---|
| 13283 | 1/1983 | Japan | 137/625.33 |
| 113184 | 4/1990 | Japan | 251/129.15 |
| 240475 | 9/1990 | Japan | 251/129.15 |
| 2029552 | 3/1980 | United Kingdom | 137/625.33 |

*Primary Examiner*—Denise L. Ferensic
*Assistant Examiner*—John Ball
*Attorney, Agent, or Firm*—Harness, Dickey & Pierce

[57] ABSTRACT

A gas valve actuator for a gas powered burner having a housing (1), an actuator (6) with plunger (7) matched to a solenoid coil (9) with a close-off spring (10) for the actuator and a current source for generating two control currents of different magnitude.

10 Claims, 3 Drawing Sheets

TWO-STAGE GAS VALVE

BACKGROUND AND SUMMARY

The invention refers to a gas valve actuator for a gas power burner in heating systems, with a housing, having a gas-inlet chamber, a gas-outlet chamber and at least one port with a valve seat, an actuator with a plunger and at least one valve seat disc, in addition to a control solenoid having a coil and a close-off spring for the actuator.

Gas valve actuators of the type described are in extensive use for dual stage operation of gas power burners. In dual stage operation, the burner is switched temperature-controlled between a first and second burner stage, with each of the two stages associated with different actuator strokes. The first stage is also used for burner ignition. For adjustment of the different opening strokes on known versions, two coils are provided which are switched in sequence to achieve the desired opening strokes. In view of the large size of the required two coils, known gas valve actuators of this nature have considerable dimensions, weights and high electrical power consumption. This is unsatisfactory.

It is the objective of the present invention to provide a suitable gas valve actuator for dual stage operation of a gas power burner that is compact in design, low in weight, and has reduced electrical power consumption.

A gas valve actuator according to the present invention compromises a single housing, a gas-inlet chamber, a gas-outlet chamber and at least one port with a valve seat, an actuator with plunger and at least one valve seat disc, and a control solenoid having a coil matched to the plunger and a close-off spring for the actuator. A current source is provided to generate two control currents of different magnitude for the solenoid coil.

The actuator has a butt-element mounted with a control gap distance to an abutting surface of a spring loading mechanism which comes into force-contact with the butt-element on the actuator opening stroke, thereby loading an auxiliary spring, when the actuator opening stroke is continued beyond its initial travel.

The current source is preferably a constant current unit, providing two control currents of different magnitude for the solenoid coil.

For example, between 40% to 60% of the rated current may be provided for the initial opening stroke and between 70% to 90% of the rated current provided for the second opening stroke. Rated current is defined as current flow through the solenoid coil at rated voltage and under standard conditions.

In a first embodiment of the present invention, the actuator penetrates the auxiliary spring, which is preloaded between a support surface in the housing and a moveable spring retention washer, mounted on the actuator stem, adjustable through the spring loading adjustment screw. With the butt-element fixed to the actuator stem, the spring retention washer is raised from its seating surface on the load adjustment screw on the actuator opening stroke. In this version the spring retention washer is the abutting surface, supported by the auxiliary spring.

When the solenoid coil is energised with control current within the range of the first opening stroke, the actuator opens against the force of the close-off spring until the butt-element contacts the spring retention washer under load of the auxiliary spring. The spring force thus achieved, in combination of the spring constants of the close-off spring and the auxiliary spring, will reach a magnitude in which the electro-magnetic force of the solenoid coil under current flow is insufficient to allow further actuator opening stroke. Accordingly, with the solenoid coil under constant current, the valve seat disc will remain in this position, determined by the spring retention washer under spring load.

The first opening stroke is equivalent to the control gap distance between spring retention washer and the butt-element and is adjustable and variable through the spring load adjustment screw.

In the event that a larger opening stroke is required, as pertaining to the second burner stage, the solenoid coil is energised with a defined higher constant current, generating electro-magnetic force sufficiently large to open the actuator against the forces of the close-off spring and the auxiliary spring.

The invention does not exclude that two or more auxiliary springs can be provided, whereby each auxiliary spring is preloaded between a support surface in the housing and a spring retention washer, mounted movably on the actuator. Each spring retention washer may have an assigned loading feature and a butt-element, mounted with control gap on the actuator. With suitable selection of control gap distances and respective control currents a gas valve actuator may be provided to permit opening strokes in several stages for three or multi-stage operation of a gas power burner.

Additionally, the gas valve according to the present invention shows that the actuator plunger can be equipped with a stem, penetrating the valve port and a housing bore below, with an auxiliary spring and the spring retention washer mounted on a stem extension stud, protruding through the housing bore, having a slot at its lower end to mate with a spring clip washer, securing a positive travel stop. The spring loading feature preferably consists of a housing cover having a tapped hole with an inserted adjustment screw. The cover seals the bottom chamber of the housing, accommodating the stem extension with the travel stop in a blind bore cavity of the spring load adjustment screw, the upper rim of which forms a ring-shaped seating surface for the spring retention washer, with the solenoid coil deenergised.

Accordingly, it will be appreciated that the construction of the present gas valve actuator is relatively simple and compact in dimension. The plunger stem is of sectional construction, carrying a valve seat disc, the bottom of which is provided with a thread connection for the stem extension stud. In this version the abutting surface is positioned above the auxiliary spring. In another version of the invention the auxiliary spring is mounted in a cylindrical cavity within the plunger, supporting a butt-element. The spring loading feature consists of an adjustment screw, inserted in the solenoid coil core, fixed to the housing, providing the abutting surface for actuator travel stop. The butt-element is fastened to a bolt, with freedom of movement within a longitudinal concentric bore of the plunger, with the auxiliary spring preloaded between the butt-element and the bottom of the plunger bore. The plunger is moveable against the ring-shaped abutting surface of the coil core, which provides a positive travel stop.

DETAILED DESCRIPTION OF THE PREFERRED EMBODIMENTS

Figure 1:
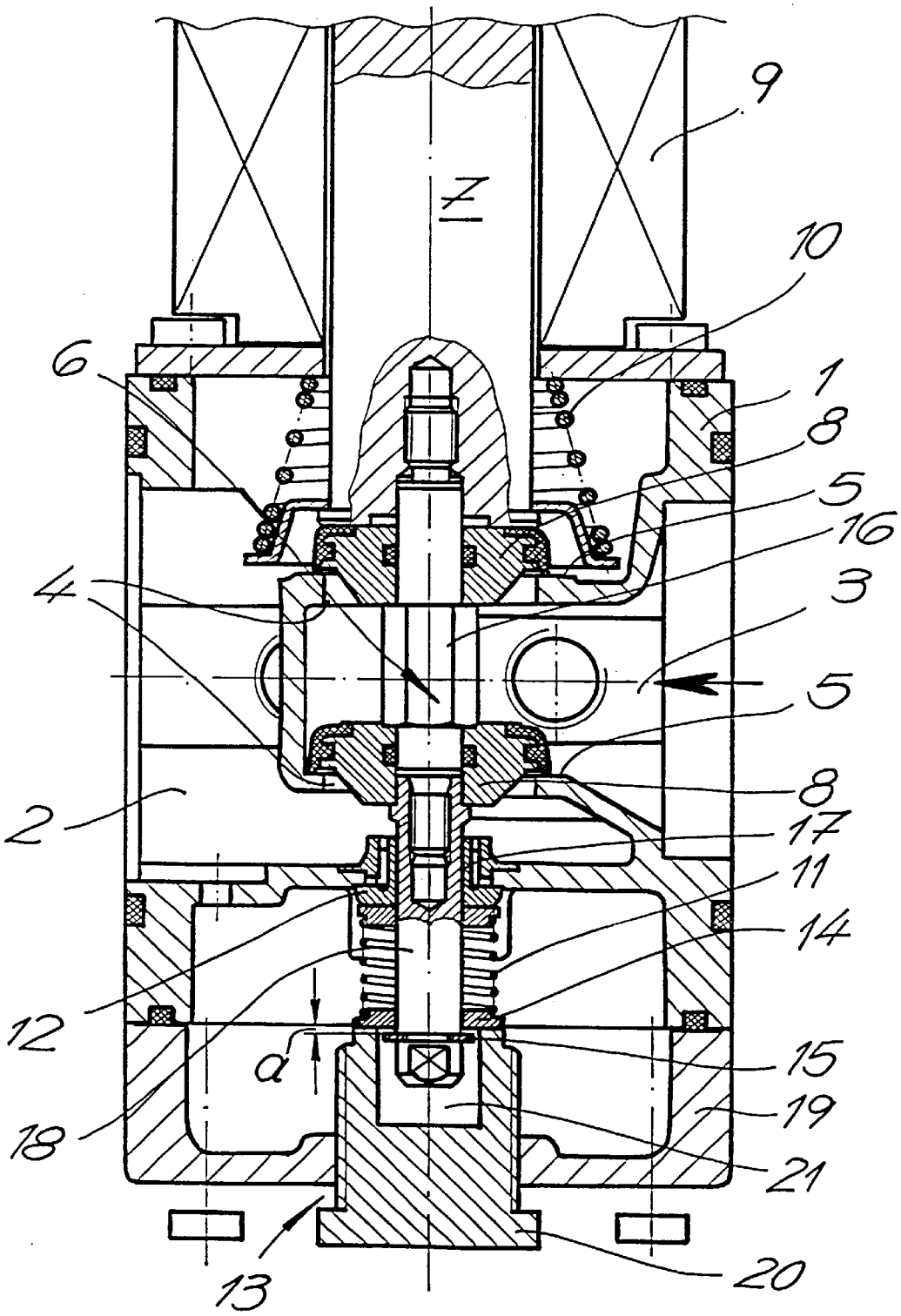
FIG. 1 A cross-section of the gas valve actuator

The gas valve actuator depicted in FIG. 1. is designed for a dual-stage gas power burner in heating systems. The gas valve actuator comprises a housing (1) having a gas-inlet chamber (3), a gas outlet chamber (2) and two ports (4) with one valve seat each (5). This is complemented by an actuator (6) with plunger (7) and valve seat disc (8), a control solenoid with a coil (9) matched to the plunger (7) and a close-off spring (10) for the actuator (6), as well as a current source for the generation of two control currents of different magnitude for the solenoid coil (9). The actuator (6) penetrates an auxiliary spring (11), also exerting pressure in the close-off direction, which is preloaded between a support surface in the housing (12) and a moveable spring retention washer (14) mounted on the actuator with a butt-element at its upper end (15), adjustable through a spring loading mechanism (13).

With the solenoid coil deenergised and actuator (6) in its closed position, as depicted, the butt-element (15) is positioned in proximity to the spring retention washer (14) with a defined control gap (a). When the actuator opening stroke is initiated under the application of control current, the butt-element is pressed against the preloaded spring retention washer (14) raising it from its seat on the top rim of the spring load adjustment screw (20).

Figure 2:
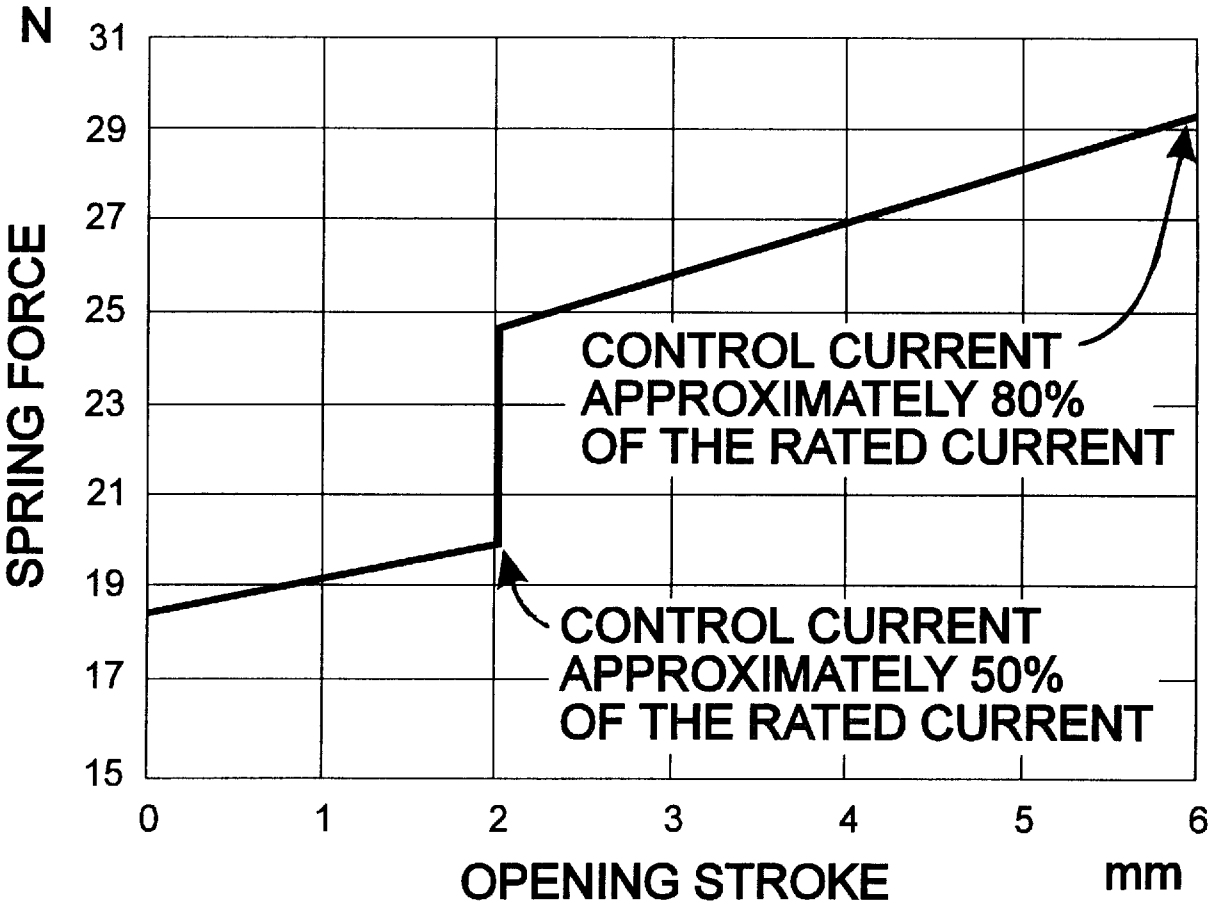
FIG. 2 The spring force characteristic curves, relating to the spring arrangement of the gas valve actuator in FIG. 1.

The operation of the gas valve actuator is graphically represented in FIG. 2, which shows the actuator spring forces in relation to the opening stroke. When the solenoid coil is energised with a control current substantially lower than the rated current, approximately 50% of rated current in this example, the plunger (7) is raised which lifts the actuator against the force of the close-off spring (10) until the butt-element (15) is pressed against the spring retention washer (14). The spring force achieved through the combination of the spring constants of the close-off spring (10) and the auxiliary spring increases to a magnitude at which the electro-magnetic force of the solenoid coil under control current is insufficient to open the valve further. Under constant control current, the actuator (6) with its valve seat disc (8) remains in the position governed by the adjustment of the spring retention washer (14).

The actuator stroke is equivalent to the control gap distance, which is 2 mm in this example. Control gap (a) and the associated opening stroke are adjustable and variable through the spring load adjustment screw (20). In the event that the gas valve actuator is required to provide a second larger opening stroke, the solenoid coil (9) is energised with a control current between 70% to 90% of rated current, which is sufficient to open the valve actuator (6) against the combined forces of the close-off spring (10) and the auxiliary spring (11). In this example the control current is set at 80% of rated current, equivalent to an opening stroke of 6 mm total.

The current source is preferably a constant current unit, which generates 40% to 60% of rated current for the first opening stroke movement and 70% to 90% of rated current for the second opening stroke movement. By limiting the control current below the rated current of the solenoid coil, undesirable heat rise in the solenoid coil (9) and the remanence force are reduced. When operating with rated current, remanence force can rise to a level which may prevent the return of the actuator when switching its position from the second to the first stage.

The construction of the actuator (6) and the spring loading adjustment screw (13) is depicted in FIG. 1. The actuator (6) is equipped with a stem (16) connected to the plunger (7), penetrating the ports (4) and a housing bore (17) below the ports (4), with a stem extension stud (18) extending through the auxiliary spring (11) and the spring retention washer (14). The bottom end of the stem extension stud is slotted to mate with a spring clip washer (15) which serves as a positive travel stop. The spring loading mechanism (13) in this example consists of a cover (19) with tapped hole into which an adjustment screw (20) is inserted. The cover (19) seals the bottom chamber of the housing (1), accommodating the stem extension (18) and travel stop (15) within the blind bore cavity (21) of the spring load adjustment screw (20), the upper rim of which forms a ring-shaped seating surface for the spring retention washer (14), when the solenoid coil (9) is deenergised.

As additionally shown in FIG. 1, the actuator stem (16) is of sectional construction, carrying a valve seat disc fastened to the plunger (7) with a mounting thread on its underside for connection of the stem extension stud (18).

Figure 3:
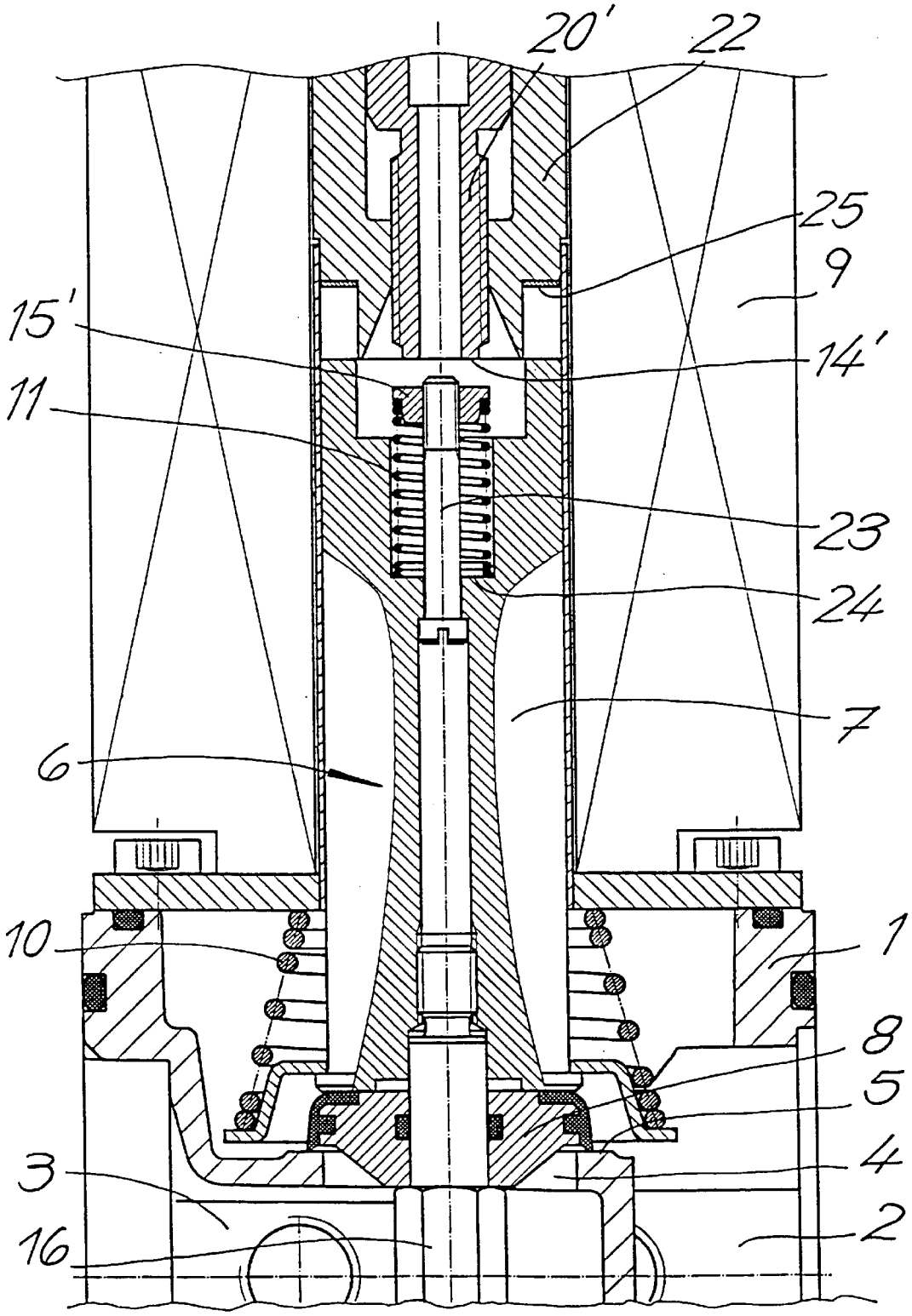
FIG. 3 A sectional extract and cross-section drawing of another variant of the gas valve actuator.

Referring now to FIG. 3, an alternative version of the gas valve actuator according to the present invention is shown. In this embodiment, the auxiliary spring (11) is located within the plunger (7) movably supporting the butt-element (15). The spring loading mechanism (13) comprises an adjustment screw (20) inserted in the solenoid coil core (22) fixed to the housing, with its bottom rim providing the abutting surface (14'). The butt-element (15') is positioned with control gap (a) in proximity to the abutting surface (14') of the spring loading mechanism.

Upon initial actuator opening stroke movent, the butt-element (15') is pressed against the abutting surface (14'). Continued opening stroke movement of the actuator then loads the auxiliary spring (11) supporting the butt-element (15'). The butt-element (15') is connected to a bolt (23) movably guided in a longitudinal concentric bore of the plunger (7) and the auxiliary spring (11) is loaded between the butt-element (15') and the support surface (24) of the plunger (7). The auxiliary spring (11) is positioned with side guidance in a cylindrical cavity of the plunger (7). Additionally, it will be noted that the plunger (7) is moveable against the ring-shaped abutting surface (25) on the underside of the solenoid coil core (22) providing the limit stop for maximal opening stroke.

While the foregoing discussion describes the preferred embodiments of the present invention, it will be appreciated that additional changes, modifications and variations can be made thereto without departing from the fair scope or meaning of the following claims.

What is claimed is:

1. A gas valve actuator for a gas powered burner in a heating system, comprising:

a housing (1) having a gas-inlet chamber (3), a gas-outlet chamber (2) and at least one port (4) with a valve seat (5);

an actuator (6) with a plunger (7) and at least one valve seat disc (8);

a solenoid having a rated current and a coil (9) matched to the plunger (7) and a close-off spring (10) for the actuator (6); a current source for generating two control currents of different magnitudes for the solenoid coil (9); the actuator having a butt-element (15,15') mounted with a control gap dimension (a) in proximity to an abutting surface (14,14') of a spring loading adjustment mechanism (13); wherein on the actuator opening stroke the butt-element (15,15') is pressed against the abutting surface (14,14') loading an auxiliary spring (11) when the actuator opening stroke is continued.

2. The gas valve actuator of claim 1 wherein the constant current source generates a first control current between 40% and 60% of the rated current of the solenoid for a first opening stroke movement and a second control current between 70% and 90% of the rated current for a second opening stroke movement.

3. The gas valve actuator of claim 1 wherein the actuator (6) penetrates the auxiliary spring (11) which is preloaded between a support surface in the housing (12) and a spring retention washer (14) mounted movably on the actuator as an abutting surface, the preload of the auxiliary spring being adjustable by the spring loading mechanism (13) including an adjustment screw; the butt-element (15) fixed to the actuator (6) raising the spring retention washer (14) from its seating surface on the adjustment screw (20) when the actuator (6) performs an opening stroke.

4. The gas valve actuator of claim 1 wherein the actuator (6) has a stem (16) mounted on the plunger (7) penetrating the port (4) and a housing bore (17) below the port, and a stem extension (18) extending through the auxiliary spring (11) and the spring retention washer (14), the stem extension having a slot at its lower end to mate with a spring clip washer (15) providing a positive travel stop.

5. The gas valve actuator of claim 4 wherein the spring loading mechanism (13) comprises a cover (19) with a tapped hole in which an adjustment screw (20) is inserted, with the cover (19) sealing the bottom chamber of the housing (1);

the adjustment screw (20) having a blind bore cavity (21) accommodating the stem extension (18) with its travel limit stop (15), and the upper rim of the blind bore cavity in the adjustment screw (20) providing a ring-shaped seating surface for the spring retention washer (14) when the solenoid coil (9) is deenergized.

6. The gas valve actuator of claim 4 wherein the actuator stem (16) is of sectional construction with a valve seat disc fastened to the plunger (7), the underside of which is provided with a mounting thread for connection to the stem extension stud (18).

7. The gas valve actuator of claim 1 wherein the auxiliary spring (11) is mounted within the plunger (7) supporting the butt-element (15') which has a spring loading mechanism (13) comprising an adjustment screw (20') that is inserted in the solenoid coil core (22) fixed to the housing, with the underside of the coil core (22) providing a ring-shaped travel stop surface (14').

8. The gas valve actuator of claim 7 wherein the butt-element (15') is connected to a movably guided bolt (23) in a longitudinal concentric bore of the plunger (7) and in which the auxiliary spring (11) is loaded between the butt-element (15') and the support surface (24) within the plunger (7).

9. The gas valve actuator of claim 8 wherein the auxiliary spring (11) is accommodated in a cylindrical cavity of the plunger (7).

10. The gas valve actuator of claim 1 wherein the plunger (7) is moveable against a travel limit surface (25) of the coil core (22).

* * * * *